US005839970A

United States Patent [19]

Lombardo

[11] Patent Number: 5,839,970

[45] Date of Patent: Nov. 24, 1998

[54] MALLET-TYPE PUTTER AND EYE PREDOMINANCE DETERMINING METHOD FOR GOLFERS

[76] Inventor: Samuel Lombardo, 12329 Tesoro Ct., San Diego, Calif. 92128

[21] Appl. No.: 782,347

[22] Filed: Jan. 13, 1997

[51] Int. Cl.[6] ..... A63B 69/36; A63B 53/04

[52] U.S. Cl. ..... 473/252; 351/178; 351/208; 351/239; 434/252; 473/409; 473/407; 473/340

[58] Field of Search ..... 473/251, 252, 473/253, 254, 409, 340; 434/252

[56] References Cited

U.S. PATENT DOCUMENTS

| | | | |
|---|---|---|---|
| 3,199,873 | 8/1965 | Surratt | 473/251 |
| 3,826,495 | 7/1974 | Elkins | 473/409 |
| 4,077,633 | 3/1978 | Studen | 473/251 |

*Primary Examiner*—George J. Marlo

*Attorney, Agent, or Firm*—John J. Murphey, Esq.; Murphey Law Offices

[57] ABSTRACT

The head of a mallet-type putter includes on its upper surface indicia in the form of a first long line, a second short line, and a series of even shorter lines extending from the end of the short line and sweeping rearward in a curved are to become parallel with the first long line. In order to compensate for a golfer's sighting error resulting from eye predominance, the long line is arranged to align putts that are ten feet or longer in distance from the golf ball to the putting cup. The short line and the arcuate array of even shorter lines are arranged to align putts that are shorter than ten feet in distance from the golf ball to the putting cup. The golfer may measure the degree of eye dominance, if any, by a sighting method that closely approximates conditions found on all golf courses including a 4 ¼ inch putting cup, and this measurement is used to arrange the different sighting lines on the putter head.

16 Claims, 6 Drawing Sheets

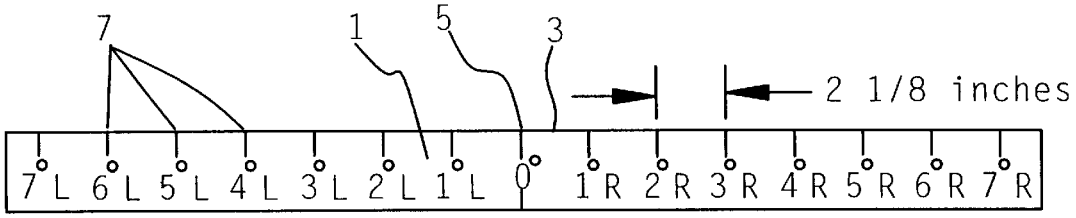
FIG 1a
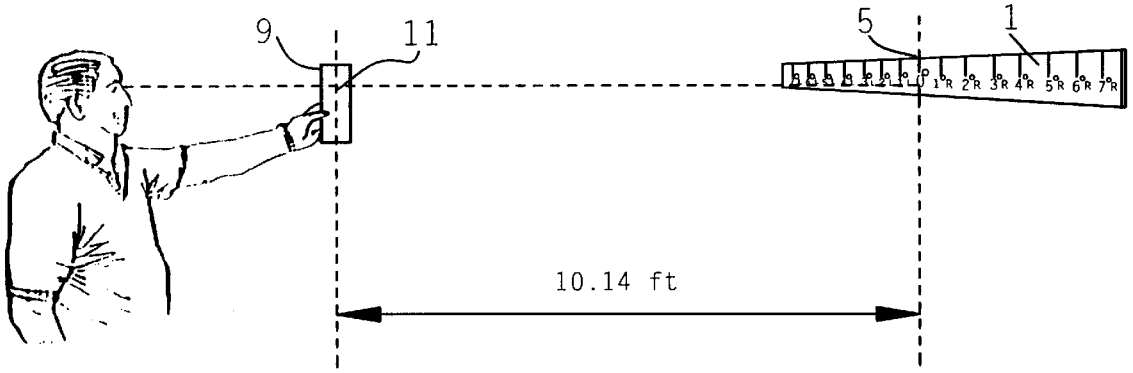
FIG 1b
TEST RESULTS
| | | |
|---|---|---|
| NO EYE PREDOMINANCE: | | 9% |
| RIGHT EYE PREDOMINANCE: | 1 degree R | = 3% |
| | 2 degrees R | = 9.5% |
| | 3 degrees R | = 3% |
| | 4 degrees R | = 4.5% |
| | 5 degrees R | = 9.5% |
| | 6 degrees R | = 28% |
| | 7 degrees R | = 18.5% |
| LEFT EYE PREDOMINANCE: | 1 degree L | = 4% |
| | 2 degrees L | = 1% |
| | 3 degrees L | = 0% |
| | 4 degrees L | = 0% |
| | 5 degrees L | = 1% |
| | 6 degrees L | = 0% |
| | 7 degrees L | = 9% |
| | | 100% |
FIG 2

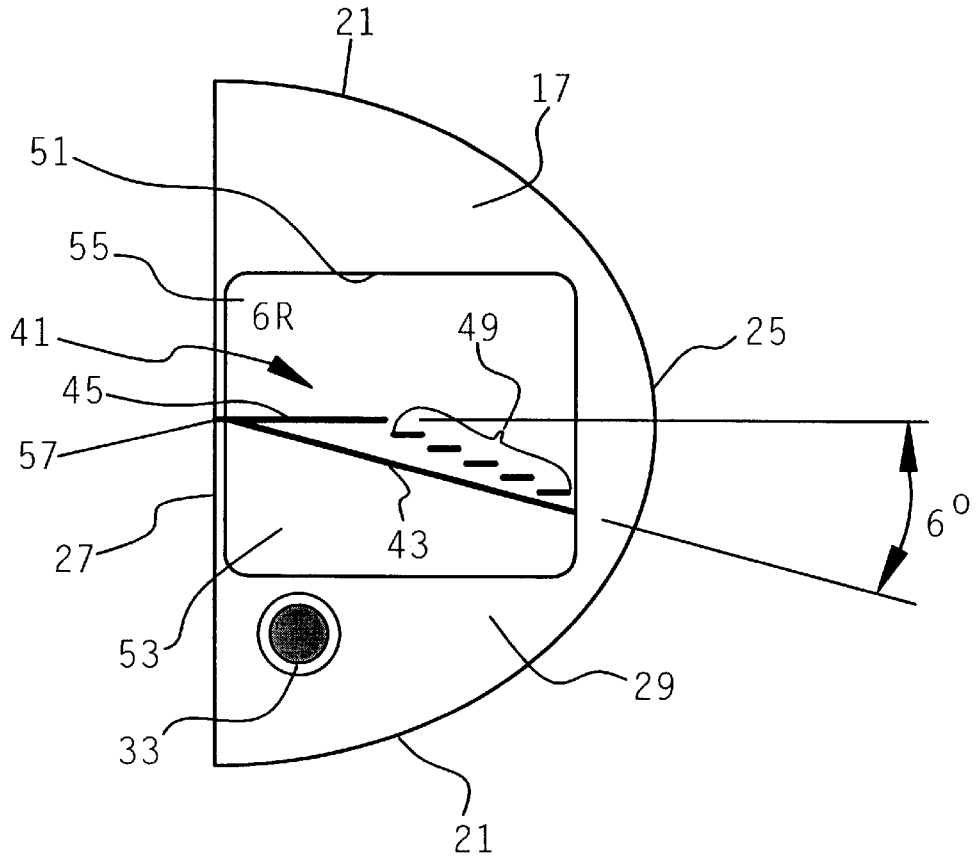

FIG 5

| EYE PREDOMINANCE | | USE OF SHORT LINE |
|---|---|---|
| For one degree right or left | = | From nine feet into the cup |
| For two degree right or left | = | From eight feet into the cup |
| For three degree right or left | = | From seven feet into the cup |
| For four degree right or left | = | From six feet into the cup |
| For five degree right or left | = | From five feet into the cup |
| For six degree right or left | = | From four feet into the cup |
| For seven degree right or left | = | From three feet into the cup |

FIG 6

| Degree of Eye Predominance | Number of Dashed Lines |
|---|---|
| 1 degree, right or left | none |
| 2 degrees, right or left | 1 dashed line |
| 3 degrees, right or left | 2 dashed lines |
| 4 degrees, right or left | 3 dashed lines |
| 5 degrees, right or left | 4 dashed lines |
| 6 degrees, right or left | 5 dashed lines |
| 7 degrees, right or left | 6 dashed lines |

FIG 7

MALLET-TYPE PUTTER AND EYE PREDOMINANCE DETERMINING METHOD FOR GOLFERS

BACKGROUND OF THE INVENTION

1. Field of the Invention

This invention relates to a system for improving the art of putting a golf ball accurately. More particularly, this invention relates to a method for discovering whether a golfer has right or left predominance and measures the degree of that predominance as well as to an apparatus upon which various alignment indicia may be placed to improve alignment and accuracy of long, intermediate, and short range putts compensating for the eye predominance.

2. Description of the Prior Art

Many golf putters have been invented for the purpose of improving putting. There are curved-shafted putters, putters with offsets in the shaft, putters that have mallet-like heads, and so on. All of them are claimed by their inventors to bring some measure of improved accuracy to the art of putting.

Other putters contain indicia that are placed on the top of the putter head so that they can be read or viewed by the golfer in his or her normal bent-over putting stance. These indicia generally comprise one or more straight or curved lines set at different angles on the club, and particularly on the head of the club. These designs claim that the golfer has a "predominance" of one eye over the other so that, when looking from the top of the putter toward the cup on the green, the predominant eye causes an error in sighting with resulting inaccuracy in the putt.

It has been found that not all golfers have an eye predominance. However, the bulk of golfers exhibit an eye predominance and, without taking it into account in the act of putting, there is inaccuracy in the putt and many putts, even the "easy ones", are missed as a result.

Golfers have the best vision of the true "line" of a putt when viewing the intended putt from the rear of the ball looking towards the cup. However, this vision becomes distorted when viewing the same "line" from the putting stance, or at ninety degrees from the "line".

Some putters of the prior art take the golfer's sighting error from eye predominance into consideration and provide for a one-time adjustment of the putter for all putts. However, these devices ignore the fact that all putts are not the same length. The one-time sighting adjustment made to these clubs may be helpful for long putts, but such an adjustment does not provide a golfer with maximum alignment efficiency for shorter putts and may actually compound the putting error in distances shorter than, for instance, ten feet.

Among the world population, a small percentage of the people have both eyes of equal strength and, thus, show no eye predominance. It is possible that the world's best golfers, past and present, fall into this category. This invention does not apply to this category of golfers and does not recommend anything to improve their putting alignment. The remainder of the population is comprised of people who have either left or right eye predominance. This invention has been developed for golfers who fall into this category.

Some surveys reveal that approximately 60–65 percent of the population exhibit right-eye predominance, while 20–25 percent exhibit left-eye predominance. Furthermore, although many golfers know that they have a predominant eye, most do not know the degree of predominance. This invention measures the degree of an individual golfer's eye predominance and then uses that information to create a putter that improves the accuracy of long, intermediate and short putts.

SUMMARY OF THE INVENTION

This invention comprises a system for determining the right eye or left eye predominance of a person and the degree of that predominance. The system then uses that information to prepare an indicia for permanent attachment to the putter that will provide the golfer with a long putt correction, a short putt correction, and an intermediate putt correction.

The invention is conveniently built into a putter comprising a shaft, handle, and mallet-type putter head. The head includes a vertical face for striking the ball, a flat bottom for contact with the putting surface, curved sides and rear wall and a flat top on which the putting alignment indicia may be conveniently mounted and observed during the putting stroke.

The alignment indicia includes a long line beginning at the top front center of the club head, extending rearward at an angle that matches the golfer's degree of eye predominance, to align putts that are ten feet or longer. It also includes a short line, beginning at the top front center of the club head, perpendicular to the center of the club face and extending rearward, to align putts shorter than 10 feet at a distance determined by the degree of eye predominance. For example, this indicia would be used at nine feet and less from the hole by a golfer with a one-degree eye predominance, at a distance of eight feet and less by a golfer with a two-degree eye predominance, and so forth. Finally, there is a series of short alternating colored dashed lines beginning at the end of the short perpendicular line and sweeping rearward in a curved arc that eventually becomes parallel with the long line, for aligning putts of intermediate distances, between 10 feet and the distance from which the short line would be used. By this means the golfer has, at his or her immediate grasp, a putting "rudder" that is useful for long, intermediate and short putts to take advantage of the golfer's eye predominance and the degree of that predominance so that putts can be made more accurately and more consistently.

Accordingly, the main object of this invention is a method for determining whether eye predominance exists with a golfer, and if so, then which eye predominates and the degree of that predominance and then uses that information to modify a putter that will produce accurate sightings from the putter to the cup to increase the accuracy of that putt. Other objects of the invention include a means for factoring the predominance of a golfer's eyes into a putter that will give accurate sightings of putts from a range of putting distances from the edge of the cup to positions well beyond ten feet from the cup; a means for determining the predominance of a golfer's eyes and the amount of that predominance so that a putter can be made to incorporate that information into the aiming aspect thereof to produce more accurate putting over a greater range of distances than is available in the prior art; a means of aiming a putter to produce more consistent and accurate putting under conditions where consistency and accuracy is important; a means of placing information of a golfer's eye predominance upon the top of a putter so that the information is readily available to the golfer when putting; a means of compensating for a golfer's eye predominance in the game of golf so as to form a "level playing field" for all who have taken up the sport; and, a means of providing an inexpensive way to accurately line up a putt so that eye problems of the golfer are virtually eliminated.

These and other objects of the invention will become more apparent upon reading the following description of the preferred embodiment taken together with the drawings appended hereto. The scope of protection sought by the inventor may be gleaned from a fair reading of the claims that conclude this Specification.

DESCRIPTION OF THE DRAWINGS

FIGURE 1*a* is a front view of the preferred embodiment of an eye predominance chart having a center point at zero and increasing to the left and to the right in one degree increments;

FIGURE 1*b* is an illustrative view of a golfer beginning to use the chart shown in FIG. 1;

FIG. 2 is a listing of the eye predominance of a sampling of 120 golfers using the chart shown in FIG. 1*a;*

FIG. 5 is a top plan view of the putter shown in FIG. 4;

FIG. 6 is a chart of the distance from the cup that the short line may be used to aim the putter;

FIG. 7 is a chart of the number of dashed lines useful in this invention depending upon the degree of their eye predominance; and, FIG. 8 is a top view of decal 53 for each set of long lines, short lines and series of dashed lines for each left and right eye predominance that is useful in this invention.

DESCRIPTION OF THE PREFERRED EMBODIMENT

Figure 3A:
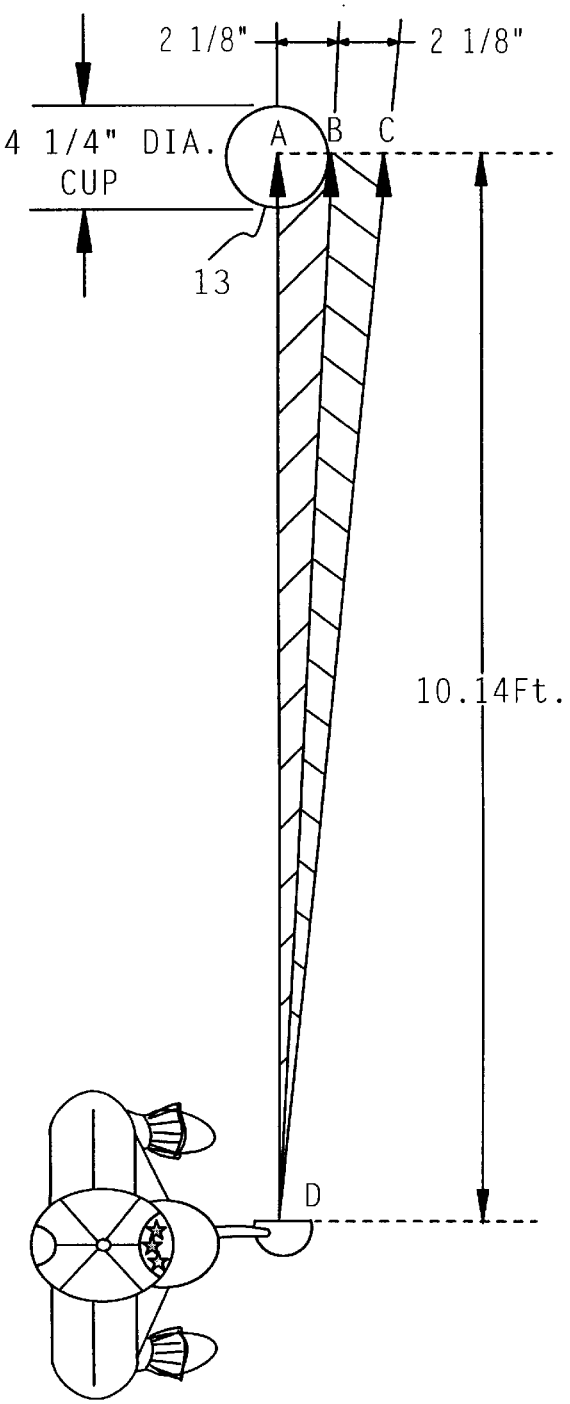
FIG. 3*a* is an illustrative view of the miss distance of a 10.14 foot putt having a one or two degree eye predominance that does not incorporate the indicia of this invention.

Turning now to the drawings, where like elements are identified by like numbers throughout the seven figures, FIGS. 1*a* and 1*b* show the method of measuring a person's eye predominance and the degree of that predominance. This test can be performed at home or in a golf "pro" shop or anywhere else where a vertical wall is provided along with sufficient room for a person to stand about eleven feet away from, and have an unobstructed view of, the wall. As shown in FIG. 1*a*, a narrow strip of paper or other sheet material forming an eye chart 1 is provided and arranged horizontally on the wall on which is drawn a horizontal line 3 containing a series of successive integers extending outward in both opposite (horizontal) directions from a center point 5. Line 3 should be parallel to the surface of the floor. Center point 5 is conveniently marked with a "zero" and represents the midpoint of strip 1.

A series 7 of points are then marked on line 3 extending outward and have integers marked on them beginning with the integer "1" next to center point 5 and continuing in arithmetical order to number "7" on each side thereof as shown. The spaces or increments between neighboring marks and accompanying numbers is conveniently set at 2 ⅛ inches, or one degree in width, as will be more fully explained later.

As shown in FIG. 1*b*, a small piece of paper or cardboard, called a "viewing card" 9 is formed, of a size conveniently held in one's hand, and has formed therethrough a small aperture 13 at or near the top thereof. The golfer stands back from strip 1 a distance in front of center point 5. The golfer extends his or her arm straight out from their body and holds viewing card 9 a distance of 10 feet 2 inches (10.14 feet) from center point 5 as shown in FIG. 1*b*.

To perform the test, the golfer focuses both eyes on center point 5 on strip 1 and brings aperture 13 up to be in line with his or her eyesight. He or she closes their left eye allowing their right eye to concentrate on center point 5. If the right eye is still focused on center point 5 then the golfer has "right-eye predominance" because the right eye has not moved from its original position. Now, without moving, the golfer closes his or her right eye and opens their left eye. If the left eye is also looking at center point 5, then this person has no eye predominance and the test should be stopped at this point as this invention will have no beneficial effects on the putting of that particular golfer.

If, however, the left eye is focused away from center point 5, then the golfer has a right-eye predominance and the number at which the golfer's left eye is focused represents the number of degrees of predominance, either left or right. For instance, if the golfer's eye is focusing on the integer "3" to the right of center point 5, then the golfer is said to have a right-eye predominance of 3 and this may be noted as "3R". If the golfer's eye is focusing on the integer "4" to the left of center point 5, then the golfer is said to have a left-eye predominance of 4 and this may be noted as "4L".

Conversely, if the golfer focuses both eyes on center point 5 on strip 1 and brings aperture 13 up to be in line with his or her eyesight and then closes their right eye allowing their left eye to concentrate on center point 5. If the left eye is still focused on center point 5 then the golfer has "left-eye predominance" because the left eye has not moved from its original position. Now, without moving, the golfer closes his or her left eye and opens their right eye. If the right eye is also looking at center point 5, then this person has no eye predominance and the test should be stopped at this point as this invention will have no beneficial effects on the putting of that particular golfer.

If, however, the right eye is focused away from center point 5, then the golfer has a left-eye predominance and the number at which the golfer's right eye is focused represents the number of degrees of predominance. For instance, if the golfer's right eye is focusing on the integer "5" to the left of center point 5, then the golfer is said to have a left eye predominance of 5 or "5L". In taking this test, one should read the series of marks 7 to the nearest integer.

The reason for marks 7 to be set at 2 ⅛ apart is that at 10.14 feet, one degree equals 2⅛ inches in width, exactly one half the width of a 4¼ inch wide putting cup. Accordingly, the test is conducted under conditions that closely approximate what is found on all golf courses. A test was made of the eye predominance of 120 men and women golfers. The results are shown in FIG. 2 and show that 7 degrees left and right represent about the maximum width of predominance. Note that with a 7 degree left or right predominance, a golfer addressing a 10 foot put would miss the cup by almost 16 inches. No wonder there is such a need for this invention!

Figure 3B:
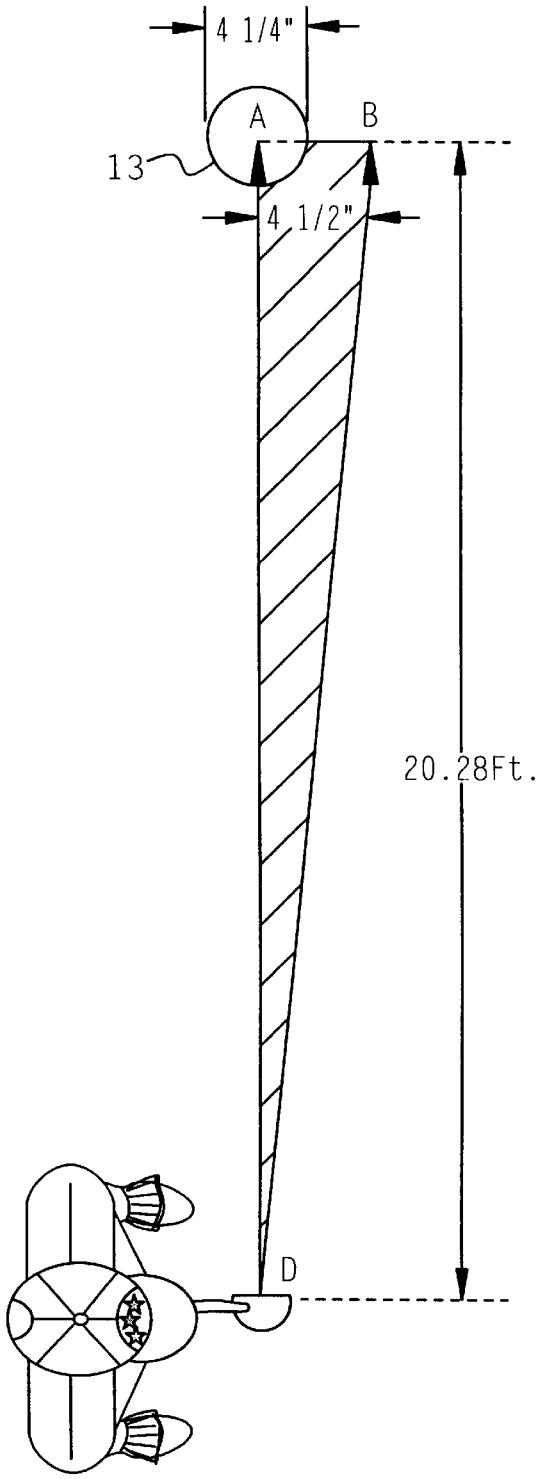
FIG. 3*b* is a similar illustrative view as FIG. 3*a* of the miss distance of a 20.28 foot putt.

The miss distance is shown in FIGS. 3*a* and 3*b* where, at a distance of 10.14 feet, a one degree predominance will make the golfer hang a perfectly aimed putt on the edge of cup 13, while at a distance of 20.28 feet, a one degree predominance will make the golfer completely miss a perfectly aimed putt. The "true line" is the line from the golf ball to the center of the cup; this is line D–A in FIGS. 3*a* and 3*b*. The "putt line" is the line sighted by the golfer, from his golf ball to what he believes is the center of the cup; this is line D–B or D–C in FIG. 3*a* and line D–B in FIG. 3*b* depending on his or her eye predominance.

Figure 4B:
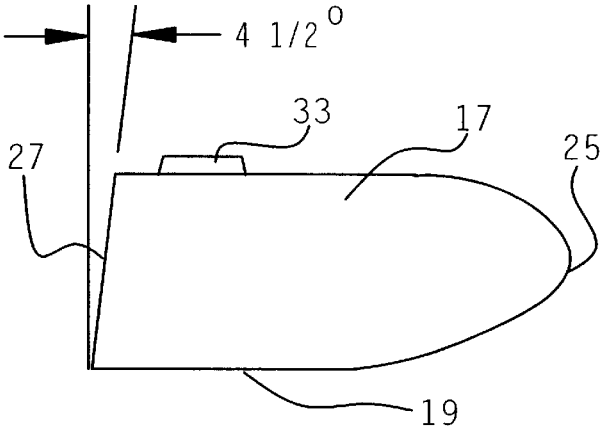
FIG. 4*b* is a sectional side view of the head of the putter shown FIG. 4*a* showing the loft or slant of the face of the putter head.
Figure 4A:
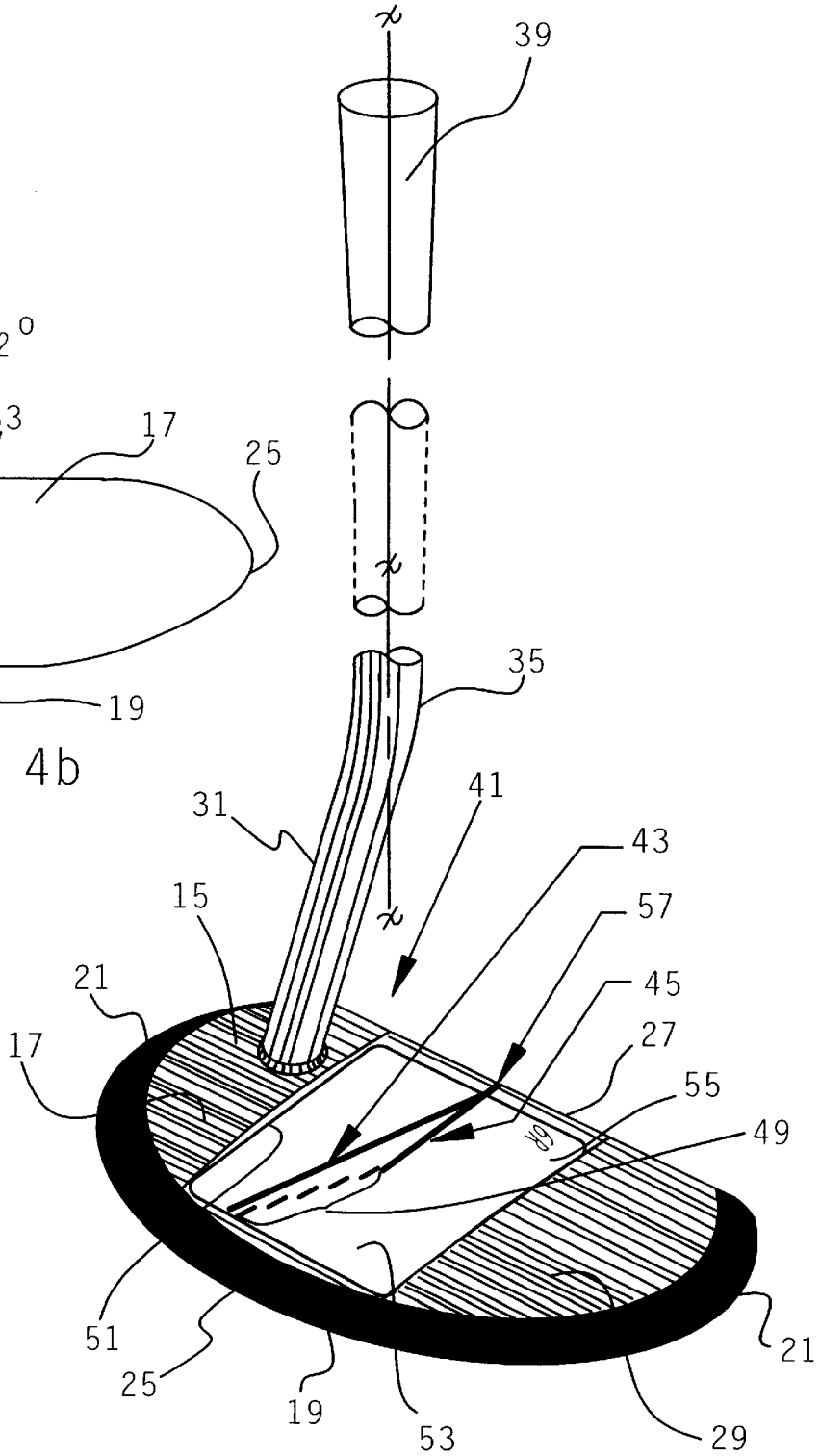
FIG. 4*a* is an illustrative view of a mallet-type putter and the preferred embodiment of this invention utilizing a decal on the head of the putter.

As shown in FIGS. 4*a* and 4*b*, a putter 15 is provided on which this invention has been incorporated. As shown in FIG. 4*a*, putter 15 comprises a broad, mallet-type head 17 that has a bottom surface 19, for contact with the putting surface (the "green"), said bottom surface 19 bounded by a pair of upstanding side walls 21, an upstanding rear wall 25, and a planar, front putting face 27, all joined together along their contacting marginal walls, said putting face 27 arranged for contact with the golf ball during the putting stroke. A top surface 29 covers over putting head 17. FIG. 4*b* shows putting face 27 to be angled backward at putting head 17 so that the putting stroke places a slight upward force vector on the golf ball to overcome some of the friction between the ball and the grass surface on which it is resting. An angle of 4½ is considered ideal for this particular type of putter.

FIG. 4*a* shows a shaft 31 extending upward a short distance, from an aperture 33 formed in putting head 17, wherein it undergoes a slight bend at 35 then continues upward along axis x—x to a grip 39 for grasping by the golfer during the putting stroke.

In the preferred embodiment, golf putter 15 is constructed so that said side walls 21 and said rear wall 25 form a single semicircular surface that begins at one end of planar putting face 27 and terminates at the other end of said planar putting face 27 as is shown in FIG. 4*a*.

As shown in FIGS. 4*a* and 5, the indicia 41 useful in this invention are conveniently grouped into three (3) sets of lines. The first solid or long straight line 43 is provided and is set at an angle from the plane of front face 27 the number of degrees (and the direction) as determined by the test described earlier. As shown (exaggerated) in FIG. 5, long line 43 is set at an angle of 6° from the plane of front face 27 and at an angle compensating for a right eye predominance. This long line 43 is to be used by the golfer in making putts of 10 feet or more in length. It is used by lining up long line 43 to coincide with the sight line from the golf ball to the cup. The sight line is shown in FIGS. 3*a* and 3*b* as lines D–A, the straight line from the center of the putter's face to the center of the cup. Long line 43 is preferably different in color than the other lines and more preferably is yellow in color to stand out from the other lines.

Research has shown that for every foot of putting distance inside ten feet from the cup, the golfer loses one degree of eye predominance. A shorter straight solid line 45, preferably white in color, is provided extending from the center of planar front face 27 rearward, and is provided for putts that are determined by the eye predominance of the individual putter. A list of putting distances, using short line 45, that are useful to the golfer and are calculated from his or her eye predominance, is shown in FIG. 6. For instance, for a golfer that has a left or right eye predominance of four degrees, he or she would use the shorter solid line 45 in putting from right next to the cup out to a distance of ("zero to [10 feet-4]") 6 feet from the cup. This number, "6 feet" is termed the "conversion point" of the putter and is the length of a putt for which short line 45 is useful. It can be viewed as the "practical end" of short line 45. FIG. 6 is a chart of the distance from the cup that short line 45 may be used to aim the putter.

For putting distances in excess of 10 feet from the cup, the golfer would use long line 43. For putts between the conversion point (such as in this example) 6 feet and 10 feet from the cup, the golfer may rely on a series of short alternating colored straight dashed lines 49 beginning at the end of the short line 45 (conversion point) and sweeping rearward, along putter head 17, in a curved arc to eventually become parallel with long line 43. Preferably, the dashed lines 49 are alternately made thick and thin to enhance their differentiation and make aiming them easy on the golfer's eyes. In addition, as shown, each dashed line begins where its neighboring dashed line terminates. This reduces confusion as to which line to use and allows more easier access to each line.

The number of dashed lines in series 49 depends upon the degree of eye predominance of the golfer. FIG. 7 is a chart of the number of dashed lines with respect of the eye predominance of a golfer. Note that the dashes run from none (for 1 degree of eye predominance, left or right) to 6 (for 7 degrees of eye predominance, left or right).

For example, for a golfer with a 2degrees eye predominance (right or left), and if the putt was between 8 feet (the conversion point) and 10 feet in length, there would be one dashed line between short line 45 and long line 43 and the golfer would line up the dash line with the cup for his or her putt. This would represent the proper distance and the proper direction to aim the putter to take into account his or her eye predominance and whether it was left or right.

As another example, suppose the golfer had a 6 degrees eye predominance (right or left), and if the putt was between 4 feet (the conversion point) and 10 feet in length, there would be 5 dashed lines between short line 45 and long line 43 and the golfer would consider each dashed line as representing one (1) foot in putting distance beyond 4 feet from the cup. Therefore, for a 7-foot putt, the golfer would line up his or her golf ball, the middle or third dashed line, and the cup and make his or her putt.

FIG. 7 is a chart of the number of dashed lines useful in this invention depending upon the degree of the golfer's eye predominance, and, is a top view of each set of long line 43, short line 45 and series 49 of dashed lines for each left and right eye predominance that is useful on the head of putter 15. Long line 43 is yellow in color, short line 45 is white in color and the dashed lines in series 47 alternate in colors of white and yellow.

Figure 8:
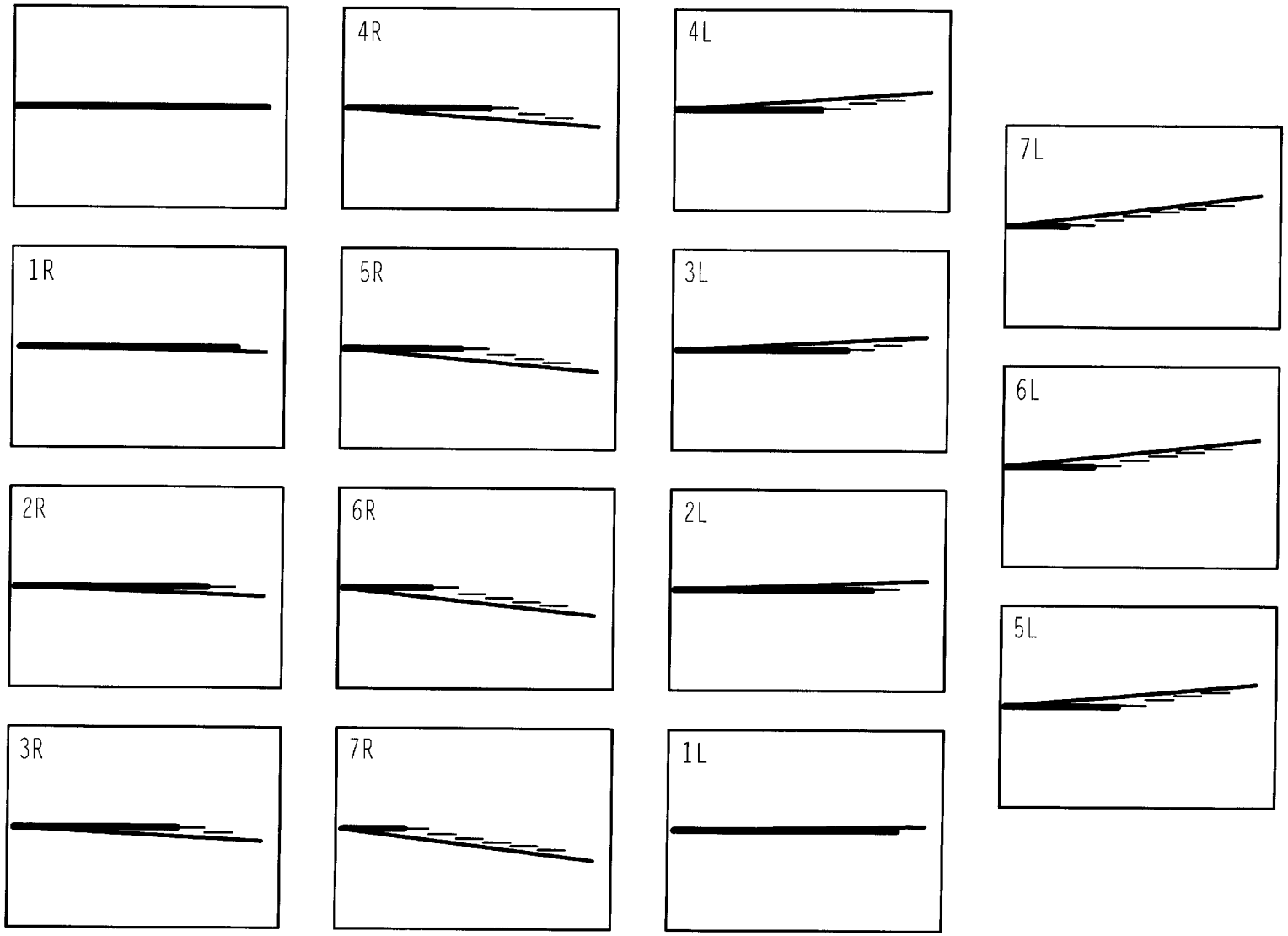

In order to personalize the putter to the golfer, it is preferred that a depression 51 be formed in putter head 17, such as that shown in FIGS. 4*a* and 5, of a size sufficiently large to accept a paste-on decal 53 that contains the proper long line 43, short line 45 and series 49 of short lines or dashes. Decal 53 can be printed on paper or other sheet material, can be warehoused at golf shops and the like, and can be made for each eye predominance and each degree of eye predominance. Decal 53 shown in FIG. 5 carries an indicator 55 of "6R" indicating that this particular decal is to be used for those who have a right eye predominance of 6°. Other indicator 55 is shown on decals 53 shown in FIG. 7. Such decals can be printed and easily glued in place centered behind the center 57 of putter face 27. FIG. 8 is a top view of decal 53 for each set of long lines, short lines and series of dashed lines for each left and right eye predominance that is useful in this invention.

In all cases, when using any of indicia 41 of this invention, the golfer must assume the standard putter's stance, similar to that shown in FIGS. 3*a* and 3*b*, i.e., he or she must utilize the lines (43, 45 and 49) by viewing them from above putter head 17. Standing behind the putter to line up the putt is not the appropriate stance in which to use the indicia of this invention.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A method for determining the eye predominance of a golfer comprising the steps of:

a) securing to a vertical surface at the golfer's eye level a horizontal eye chart having a marked center at zero and other marked points increasing in one degree increments to the right and to the left of said center, each increment being 2⅛ inches from its neighboring increment;

b) standing the golfer at a distance perpendicular to said center point of said eye chart and at the same level thereof such that his or her hand on their arm, extended toward said center point, is 10 feet 2 inches from said center;

c) having the golfer hold a viewing card in the hand of their extended arm, said card having formed therethrough an aperture for viewing said chart;

d) having the golfer hold the viewing card with arm fully extended and with both eyes open, looking through said aperture toward said chart and focusing both eyes on said chart at said center;

e) having the golfer close their left eye to determine if right eye predominance exists, and, if it does, then opening the left eye and determining at which increment the left eye is focusing to determine the degree of right eye predominance; and, f) having the golfer close their right eye to determine if left eye predominance exists, and, if it does, then opening the right eye and determining at which increment the right eye is focusing to determine the degree of left eye predominance.

2. The method of claim 1 wherein the step of securing to a vertical surface at the golfer's eye level a horizontal eye chart having a marked center at zero and other marked points increasing in one degree increments to the right and to the left of said center, each increment being 2⅛ inches from its neighboring increment involves the step of ceasing to mark points on said chart after reaching seven degrees to the right and to the left of said center.

3. A putter alignment system, comprising:

a) a mallet-type golf putter including a broad head comprised of a bottom surface for contact with the putting surface, said surface bounded by a pair of upstanding side walls, an upstanding rear wall, a planar front putting face with a center point marked thereon, and a top surface, all said surfaces and said walls joined together along their respective contacting marginal edges;

b) an elongated shaft having a grip at one end and being joined to said putter head at the other end for the golfer to grasp and swing during the putting sequence;

c) a long straight indicia line set on said top surface of said putter head, for viewing by the golfer during the putting sequence, said line beginning at the top of said center point of said club head and extending rearward toward the top rear of said club head, at an angle to the perpendicular of said club face that matches the golfer's degree of eye predominance, to align putts that are ten feet or longer in distance from the golf ball to the cup;

d) a short straight indicia line, beginning at the top of said center point of said club head, perpendicular to the plane of said front putting face of said putter and extending rearward a shorter distance than said long straight indicia line, to align putts shorter than ten feet at a distance from the golf ball to the cup determined by the degree of eye predominance; and, e) a series of short alternating straight dashed lines beginning at the end of said short line and sweeping rearward in a curved arc to eventually become parallel with said long line, for aligning putts of intermediate distances, between ten feet and the distance from which the short indicia line would be used.

4. The putter alignment system of claim 3 wherein said side walls and said rear wall form a single semicircular surface that begins at one end of said planar putting face and terminates at the other end of said planar putting face.

5. The putter alignment system of claim 3 wherein said putter shaft includes at least one bend formed therein to position said putting head apart from the main axis of said shaft.

6. The putter alignment system of claim 3 wherein said long, straight indicia line is of a different color than said short indicia line.

7. The putter alignment system of claim 3 wherein said long, straight indicia line is yellow in color.

8. The putter alignment system of claim 3 wherein said short indicia line is white in color.

9. The putter alignment system of claim 3 wherein said series of short alternating straight dashed lines are made alternately thick and thin in width.

10. The golf-putter of claim 3 wherein said series of short alternating colored dashes are each of a length that one dash begins where the neighboring forward dash ends.

11. The golf putter of claim 3 where said series of short alternating colored dashes are from zero to six in number and are of equal length.

12. A putter alignment system, comprising:

a) a mallet-headed golf putter including a head comprised of a broad bottom surface for contact with the putting surface, said surface bounded by a pair of up-standing side walls, an upstanding rear wall, a planar front putting face with a center point marked thereon, and a top surface, all said surfaces and said walls joined together along their respective contacting marginal edges wherein said side walls and said rear wall form a single semicircular surface that begins at one end of said planar putting face, pass around the rear of said head, and terminate at the other end of said planar putting face;

b) an elongated shaft having a grip at one end and being joined to said putter head at the other end for the golfer to grasp and swing during the putting sequence wherein said putter shaft includes at least one bend formed therein to position said putting head apart from the main axis of said shaft;

c) a long straight indicia line set on said top surface of said putter head, for viewing by the golfer during the putting sequence, said line beginning at the top of said center point of said club head and extending rearward toward the top rear of said club head, at an angle to the perpendicular of said club face that matches the golfer's degree of eye predominance, to align putts that are ten feet or longer in distance from the golf ball to the cup;

d) a short straight indicia line, beginning at the top of said center point of said club head, perpendicular to the plane of said front putting face of said putter and extending rearward a shorter distance than said long straight indicia line, to align putts shorter than ten feet at a distance from the golf ball to the cup determined by the degree of eye predominance; and, e) a series of short alternating straight dashed lines beginning at the end of said short line and sweeping rearward in a curved arc to eventually become parallel with said long line, for aligning putts of intermediate distances, between ten feet and the distance from which the short indicia line would be used.

13. The putter alignment system of claim 12 wherein said long line is colored yellow.

14. The putter alignment system of claim 12 wherein said short line is colored white.

15. The putter alignment system of claim 12 wherein said dashed lines are colored alternately white and yellow.

16. The putter alignment system of claim 12 wherein said indicia lines are printed on a plastic decal for attaching to said putter head.

* * * * *